US006119603A

United States Patent [19]

Lochridge

[11] Patent Number: 6,119,603

[45] Date of Patent: Sep. 19, 2000

[54] TILTED WORK SURFACE FOR RETRO FIT USE

[76] Inventor: Edwin P. Lochridge, 452 Ridgewood Rd., Atlanta, Ga. 30307

[21] Appl. No.: 09/011,944

[22] PCT Filed: Aug. 23, 1996

[86] PCT No.: PCT/US96/13676

§ 371 Date: Apr. 22, 1998

§ 102(e) Date: Apr. 22, 1998

[87] PCT Pub. No.: WO97/07710

PCT Pub. Date: Mar. 6, 1997

Related U.S. Application Data

[60] Provisional application No. 60/002,688, Aug. 23, 1995.

[51] Int. Cl.[7] ..... A47B 23/00

[52] U.S. Cl. ..... 108/43; 108/90

[58] Field of Search ..... 108/1, 6, 90, 43, 108/38, 39, 50.01, 50.02, 50.11; 248/918, 922, 923

[56] References Cited

U.S. PATENT DOCUMENTS 905,836 12/1908 Bowman .
1,436,859 11/1922 Bush .
2,569,310 9/1951 Hitt .
2,628,147 2/1953 Berner .
3,172,636 3/1965 Collier .
4,422,640 12/1983 Tamarkin .
4,781,126 11/1988 Lochridge .
5,081,936 1/1992 Drieling .
5,090,334 2/1992 Sutton .
5,158,257 10/1992 Wilson ..... 248/918 X
5,240,210 8/1993 Honto, Jr. et al. ..... 248/918 X
5,481,987 1/1996 Maitland ..... 108/90
5,555,819 9/1996 Lochridge .

*Primary Examiner*—Jose V. Chen
*Attorney, Agent, or Firm*—Merchant & Gould P.C.

[57] ABSTRACT

A work surface system provides ergonomic benefits to traditional office environments in a retro fit fashion. The work surface system includes a work surface and a support for supporting the work surface at an angle with respect to horizontal. The work surface provides support for the user's arms while using a keyboard or mouse. The work surface can be smaller than the surface on which the work surface system rests. The angle of the work surface can be adjusted if desired, and the work surface also can be mounted on the support in a pivoting fashion to permit the work surface to be tipped up to permit access to a storage space beneath the work surface if desired. The work surface can include a separately adjustable keyboard support.

7 Claims, 5 Drawing Sheets

TILTED WORK SURFACE FOR RETRO FIT USE

This application claims benefit of Provisional Application Ser. No. 60/002,688 filed Aug. 23, 1995.

BACKGROUND OF THE INVENTION

The present invention provides a tilted work surface which easily can be applied to existing furniture for providing a more ergonomically correct environment.

The introduction of the personal computer into the office has resulted in enormous changes in the workplace. While personal computers have provided many new capabilities and in many cases have become essential tools in the workplace, it is now being recognized that the extensive use of the personal computer, especially in conjunction with traditional office furniture systems, can have an undesirable negative effect on the health and productivity of the office worker.

Such problems have been the object of intensive study in recent years, as the problems have become more prevalent. One aspect which has caused significant problems is the operation of input devices like keyboards and mice for extended periods of time. Often, the solutions to this problem have required the computer operator to adopt and maintain a quite upright posture. One example of this has been to mount the keyboard to the work surface via a mechanical arm which articulates so as to bring the keyboard out from the work area, toward the user, and to allow for height and/or tilt adjustment. However, this approach suffers from several drawbacks. First, it is now recognized that the strict upright posture can place undesirable stress on the user's upper torso. The worker must hold his hands up at the keyboard, requiring static muscular effort in the arms and shoulders, and creating stress in the back. Moreover, such a keyboard position requires the operator to look down to see the keyboard, thus placing undesirable stress on the neck. In addition, bringing the keyboard out from the work surface means the user is farther from the work surface, making it difficult to write notes, use a mouse. etc. for which the work surface is required. Moreover, with these systems, when the keyboard is not in use, it is usually stored beneath the work surface, taking up room beneath the surface and preventing the operator from sitting comfortably. In addition, the systems are expensive and difficult to install or remove.

An approach which does not suffer from the drawbacks outlined above is a system which utilizes a tilted or tiltable work surface, with the portion of the work surface facing the user being provided with a cut-out area, so that the user can be partially surrounded by the work surface. This permits the user to assume a more reclined posture for improved back support, while simultaneously providing support for the arms of the user, further reducing stress on the upper torso. An example of such a system is the "PowerStation" available from Metamorphosis Inc. of Atlanta, Ga. While these systems have provided significant benefit to office workers, the integration of such systems into the workplace requires the complete replacement of existing furniture. This can be inconvenient and costly, and limits the practical availability of such technology for many workers. Thus, it would be desirable to provide a system by which the benefits of the more ergonomically enlightened approaches can be made available in a form which is suitable for retro fit application with existing office furniture.

SUMMARY OF THE INVENTION

It is the object of this invention to provide a system through which an ergonomically advanced work surface can be provided on traditional office furniture in a convenient and inexpensive retro fit manner.

In another aspect of the present invention, the functionality of the tilted work surface is improved by providing an area of the work surface which can hold the keyboard in a variety of tilted positions, thereby allowing the operator to set the angle of the keyboard at the most desirable position independently from the position of the work surface.

In a still further aspect of the present invention, the work surface is of sufficient size so as to provide an area adjacent a keyboard for operation of a mouse for a computer.

The above objects and others are obtained with a system that includes individual supports or a frame that can easily rest on or be mounted on a traditional desk surface and which carries a work surface at an angle with respect to horizontal. In a preferred embodiment, the work surface is pivotally mounted to the frame, so that it can be flipped up to permit access to the area underneath the work surface. It is further preferable to provide the portion of the work surface which is distal with respect to the position of the user with a cut-out portion, and to locate the frame in this cut-out portion. A keyboard support can be provided in the cut-out portion, which is maintained in position by the work surface, but which is capable of independent adjustment to a different angle.

DETAILED DESCRIPTION

Figure 1:
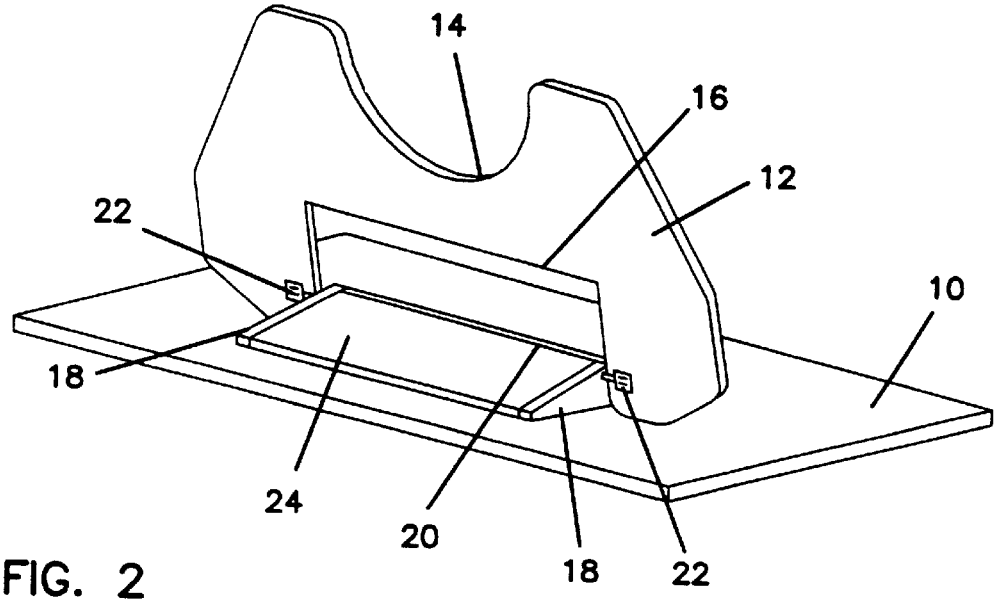
FIG. 1 is a perspective view of the work surface system of the present invention, with the work surface flipped up.
Figure 2:
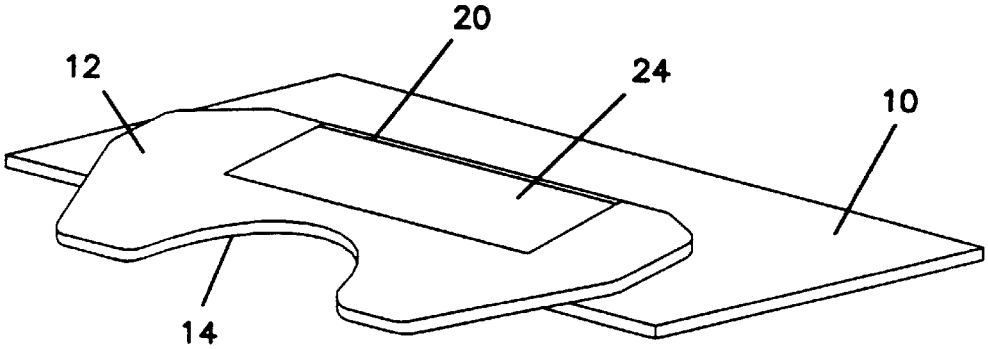
FIG. 2 is a perspective view of the work surface system of the present invention, with the work surface down.
Figure 3:
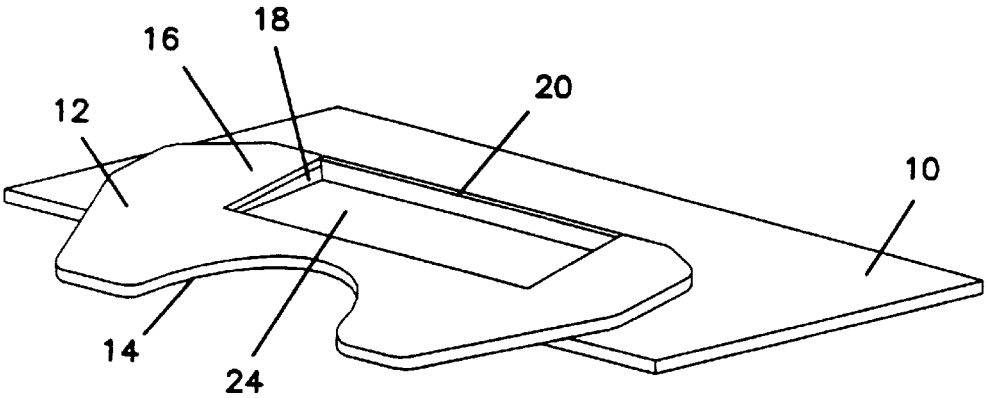
FIG. 3 is a perspective view of the work surface system of the present invention, with the work surface down and the keyboard support tilted with respect to the work surface.

Referring to FIGS. 1, 2 and 3, the work surface system of the present invention can be used in connection with a traditional work surface 10. This can be a desk top, table top, etc. The desk, table or the like, of course, also will have a suitable support structure, e.g. legs for a table or a pedestal for a desk, which are not illustrated in FIGS. 1–3. However, examples of suitable arrangements can be seen in FIGS. 6 and 7.

The system of the present invention includes a work surface 12, which is disposed at an angle with respect to the desk or tabletop in use. Angles of up to about 15° generally have been found to be useful for ergonomic purposes. The side of the work surface 12 which in use is positioned closest to user is provided with a part-circular pocket 14. Thus, the user will sit in the pocket area, partially surrounded by the work surface 12. The pocket 14 may have a diameter of about 45 cm in one example, and this dimension can be varied as necessary.

This provides support surfaces for the user's arms during typing, and brings essentially the entire work surface 12 within easy reach of the user, even when the user is in a somewhat reclined position. In addition, the work surface 12 is of a sufficient size that when a keyboard is positioned on the work surface there is space on the work surface adjacent the keyboard so that the user can operate a mouse on the work surface, even when the keyboard is centered on the work surface with respect to the home keys. In general, the work surface 12 should have a width of at least about 100 cm for this purpose in view of the size of keyboard in widespread use today. It is preferred that the width be no more than about 150 cm. It also is preferred that the work surface 12 have a depth from front to back within the range of about 50 cm to 75 cm. The work surface 12 of the embodiment of FIGS. 1–3 will have a width of about 140 cm and a depth from front to back of about 65 cm. The area of the work surface 12 is less than that of the surface 10 on which the work surface system rests. This provides a flat surface adjacent the work surface 12 for conveniently supporting a beverage cup, books, papers, pens, pencils and the like.

In one embodiment, the edge of the work surface which is distal with respect to the position of the user is provided with a rectangular cut-out area. This corresponds to the location of the keyboard, as discussed in more detail below.

The work surface 12 may be supported by a frame which includes side members 18 and back member 20. In one embodiment, the work surface 12 is pivotally mounted to the frame, particularly the side members, for example by means of pivot pin or hinge 22. In a further aspect of this embodiment, the frame is dimensioned so as to fit at the edges of cut-out area 16. The frame can be made of wood, metal, plastic or any other material suitable for carrying out the required function.

The frame may be secured to desk or tabletop 10 by any suitable fastening system, including, for example, screws, clamps, releasable adhesive or a hook-and loop system such as that known as VELCRO. A releasable system, such as the adhesive or VELCRO-type systems, is advantageous in that it would permit ready repositioning of work surface system. The configuration of the present work surface system renders the present system readily applicable to virtually any existing desk of tabletop, regardless of the thickness of the surface 10, the presence and/or location of drawers, etc. The fastening system should have sufficient strength to prevent the inadvertent tipping of the work surface system, which could occur for example when the user leans on the work surface 12 to stand up. If the work surface system is made sufficiently heavy to resist such tipping, it may be possible that the fastening system can be omitted.

The frame should be positioned on the desk or tabletop 10 so that the part-circular pocket area 14 is disposed just beyond the edge of the desk or tabletop 10. In addition, if the work surface 12 is attached pivotally to the frame to permit the work surface 12 to be flipped up, the pivot point will be positioned so that, when the work surface 12 is flipped up, the distal edge will contact the desk or tabletop in an orientation that will permit the work surface 12 to stand with relative security. This is advantageous since the disposition of the work surface 12 at an angle with respect to the desk or tabletop creates a storage space underneath the work surface 12, and access to this storage area is facilitated by permitting the work surface 12 to assume an upright position. In addition, it is contemplated that the frame and/or work surface 12 could be adapted so that the work surface could assume different angles with respect to the desk top as desired by the user. In such a case, a system such as that shown in U.S. Ser. No. 08/384,572 filed Feb. 6, 1995, the disclosure of which is incorporated herein by reference, could be used. In this system, a notched plate, pivotally mounted on the underside of the work surface for example, releasably engages a pin mounted on the frame. By releasing the plate from the pin and re-engaging with a different notch, the tilt angle of the work surface can be adjusted.

Board 24 is provided to support the computer keyboard. The orientation of the board 24 is adjustable with respect to work surface 12, as seen in FIG. 3. In one embodiment, the board 24 is not secured to the frame, although movement of the board 24 is limited by the frame back and side members and the edge of rectangular cut-out 16 which is closest to the user. In such a case, the orientation of the board 24 can be controlled easily, for example by means of shims placed underneath the board 24. Alternatively, a system such as that shown in Ser. No. 08/384,572 again could be used to permit cooperation between the distal edge of the board 24 and the frame back member to permit adjustment of the board 24. Since the board 24 is not secured to the frame, the user can raise the near edge of the board, particularly when the work surface 12 is in its upright position as illustrated in FIG. 1, thus creating an accessible storage space beneath board 24. This is particularly convenient for storage of the keyboard when it is not in use. The near edge (with respect to the user) of the board 24 and the corresponding edge of the cut-out 16 can be provided with complementary notches. This provides more secure support for the board and also reduces the gap formed between the board and the edge when the board 24 is tilted with respect to work surface 12.

It should also be understood that the cut-out and tilt-adjustable keyboard support board 24 system could be applied to other environments. For example, it could be used with an original piece of furniture which is provided with a tiltable work surface. e.g. the "PowerStation" mentioned above. In such a case, the frame members would be secured to the underside of the work surface, rather than to an existing desk or table top. This would permit independent adjustment of the keyboard angle with respect to the tiltable work surface.

In the illustrated embodiment, the board 24 is supported in a position so that the board 24, frame side members 18, and the adjacent portions of surface 12 can form a substantially smooth and continuous surface, if the option of adjusting the tilt of the keyboard is not desired, it would be possible to eliminate board 24, and instead form a unitary surface over the entire area encompassed by work surface 12, i.e. work surface 12 could rest on top of the frame members. In such a case, the work surface 12 could be supported in the desired angular orientation by a pair of legs, rather than a fully integral frame 18. It should also be understood that, if desired, the work surface could be fixed to the frame members or legs without the need for hinges 22, if it is not necessary to permit the flipping up of the work surface to provide access to a storage space beneath the work surface.

Figure 4:
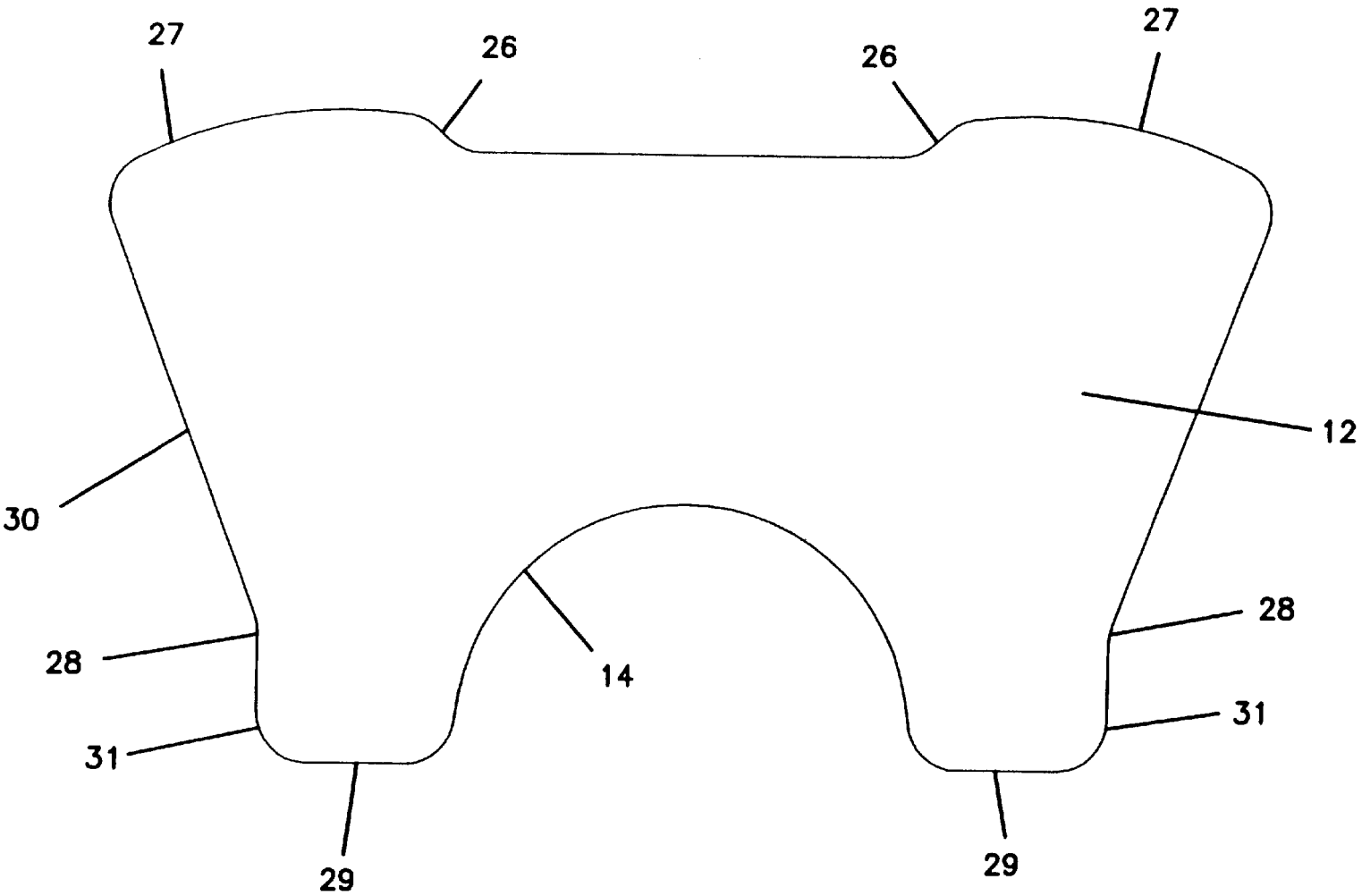
FIGS. 4 and 5 are top views of additional configurations of the work surface.
Figure 5:
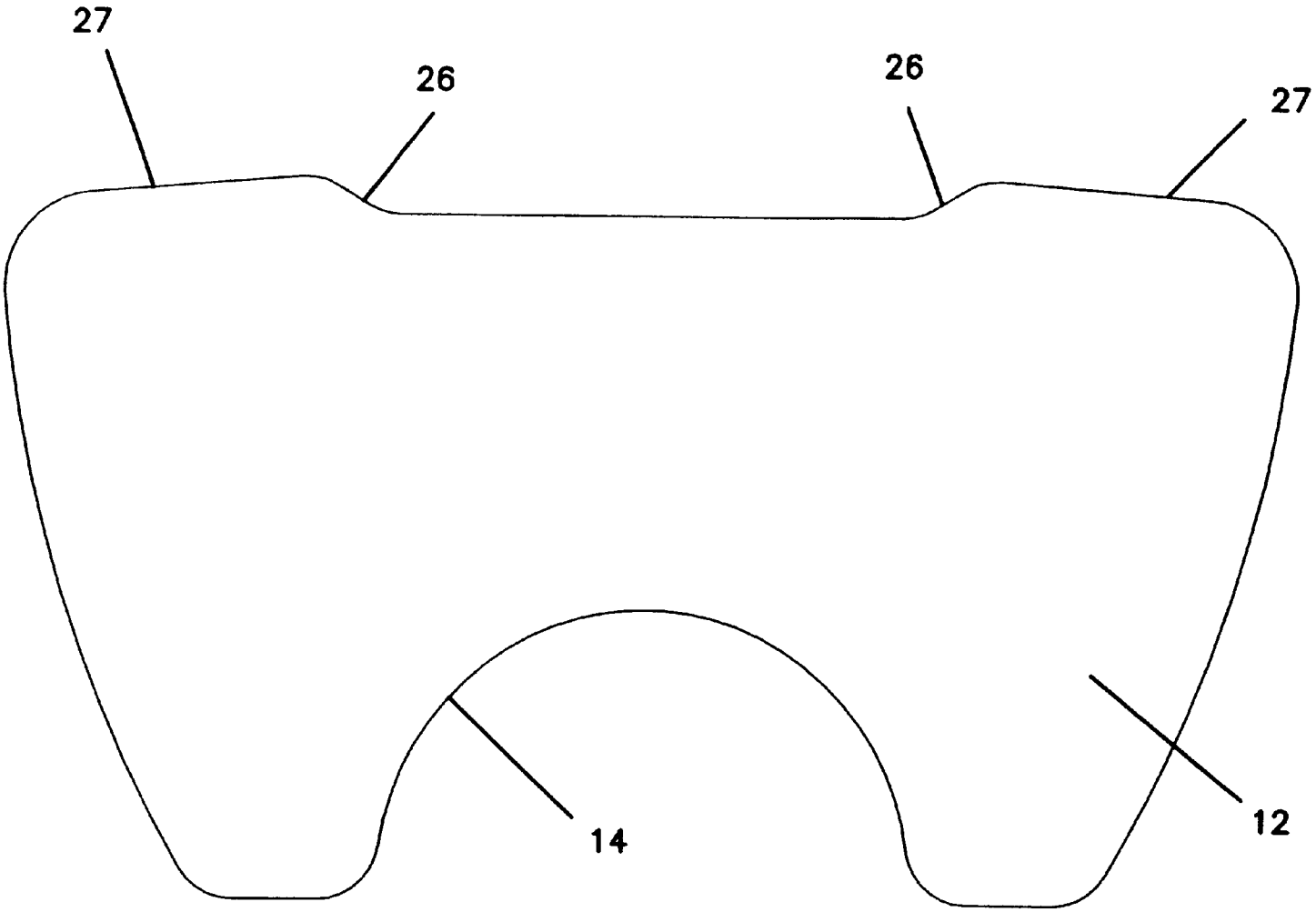

Additional configurations for the works surface 12 are seen in FIGS. 4 and 5. In general these configurations are somewhat smaller than that illustrated in FIGS. 1–3. For example, the embodiment of FIG. 4 can have a width of about 115 cm, while that of FIG. 5 can have a width of about 110 cm. In each case, the depth from front to back can be about 55 cm. These sizes still are sufficient to provide adequate space for arm support and for mouse operation adjacent a keyboard of the size generally used at present. In addition, the embodiments of FIGS. 4 and 5 include cut out portion 26 at the distal edge of the work surface 12, The portion 26 may extend inwardly about 2 or 3 cm into the distal edge, and may originate about 25 cm from the sides of the work surface 12. The portion 26 permits easier access to the surface 10 at the distal edge of the work surface 12, without significantly reducing the efficient use of the work surface 12. This also provides a space for accepting the computer monitor, thereby permitting the monitor to be located at a position closer to the user if desired. The portion 26 is sized to accept monitors of varying sizes.

Curved portions 27 may be provided outward of the cut out portion 26, and these may have a radius of curvature of about 55 cm in one embodiment. The curved portions 27 improve the efficiency of use of the distal portions of the work surface 12 while still permitting access to the surface 10 if desired.

The embodiment of FIG. 4 includes further lateral cut out portions 28. In the illustrated embodiment, the long sides 30 of the portions 28 will be disposed at an angle of about 67° with respect to the proximal edge 29. The two proximal edge sections each may have a width of about 15–17 cm, and the short sides 31 of the portions 28 will have a depth from front to back of about 12 cm. The corners between 27 and 30, between 31 and 29 and between 29 and the cut out pocket may have a radius of curvature of about 5 cm. The embodiment of FIG. 5 will have similar dimensions, although in this case the sides of the work surface are not provided with the cut out portion 28, but instead have a smooth and slightly convex configuration. The dimensions discussed above are advantageous from an ergonomic standpoint for most users, and are provided taking into account the movement about a user's shoulder and elbow joints.

Figure 6:
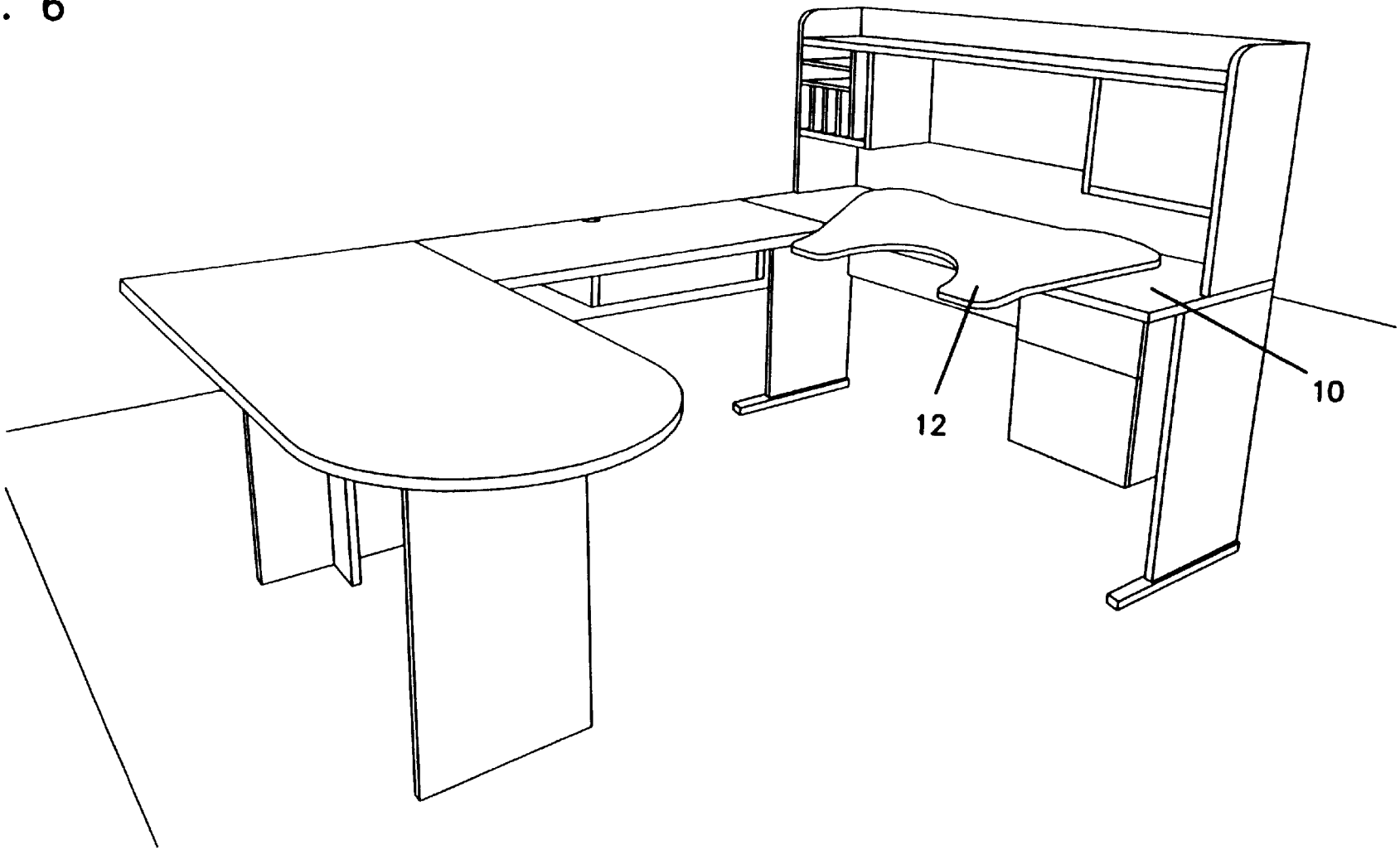
FIGS. 6 and 7 are views illustrating the work surface system of the present invention in place in an office environment.
Figure 7:
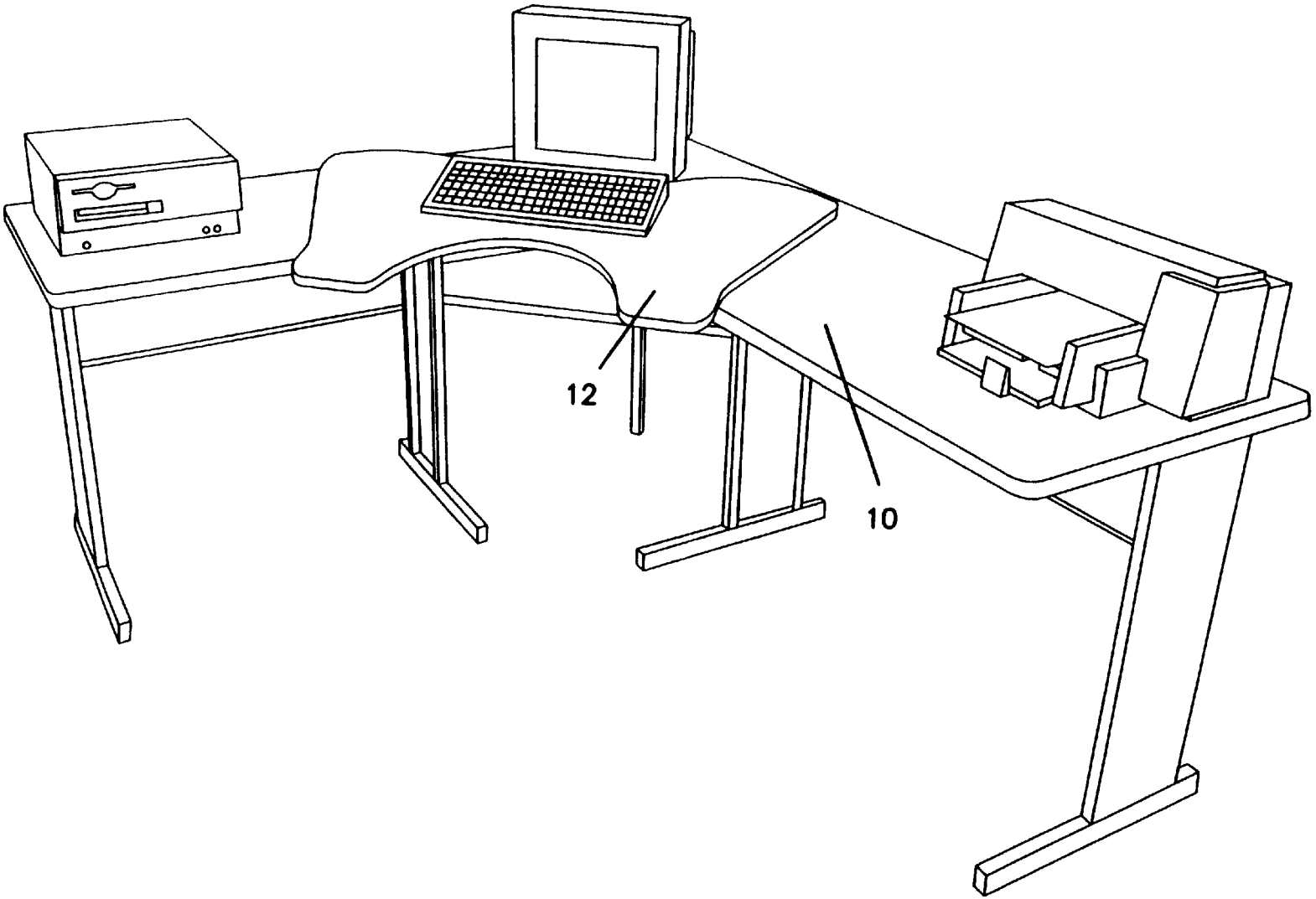

It also should be recognized that the work station environments exemplified in FIGS. 6 and 7 could be further modified to take advantage of the characteristics of the present work surface system. For example, a shelf could be provided to support a computer monitor at a desirable height above a surface 10. The work surface 12 could be mounted on drawer-like sliders beneath the shelf, thereby allowing the work surface 12 to be stored under the shelf and moved out from under the shelf for use.

As a further modification, the present work surface system could be used in a training situation. In such a case, the work surface 12 would have a much greater width and would include a plurality of cut out pockets 14. The width of the work surface and the number of pockets could be varied as necessary to meet the needs of a given situation.

It can be seen that the present invention provides a work surface which easily and inexpensively permits ergonomic advances to be applied to conventional office furniture. In addition, it will be appreciated that the present invention is easily removed and transported, creating a portable ergonomic environment. The present invention is not limited to the disclosure provided above and modifications not departing from the spirit of the present invention will be apparent to those skilled in the art. The invention is defined by the claims that follow.

I claim:

1. A work surface system suitable for retrofit use, comprising:

a work surface;

a support for supporting the work surface on a horizontal surface at an angle with respect to horizontal, the work surface having a first edge positioned proximal to an intended normal location of a user of a keyboard supported on the work surface system and a second edge positioned distal to an intended normal location of a user of a keyboard supported on the work surface system, the second edge comprising a cut out portion;

a computer keyboard support in the cut out portion, capable of assuming a non-coplanar orientation with respect to the work surface;

wherein the work surface has a size sufficient to provide support for arms of a user of a keyboard supported on the computer keyboard support.

2. The work surface system of claim 1, wherein the work surface has a size sufficient to permit a user to operate a computer mouse on the work surface adjacent to a computer keyboard supported on the work surface.

3. The work surface system of claim 1, wherein, the first edge comprises a cut out pocket for the user whereby the work surface partially surrounds the user.

4. The work surface system of claim 1, wherein the orientation of the keyboard support with respect to the rest of the work surface is variable.

5. The work surface system of claim 1, wherein the work surface is pivotally mounted to the support, whereby the work surface can be pivoted upward to permit access to a space beneath the work surface.

6. The work surface system of claim 5, wherein the space beneath the work surface is sufficient for storage of a computer keyboard.

7. A work station, comprising:

a first horizontal surface;

a work surface system installed in a retrofit manner on the first horizontal surface, the work surface system comprising:

a work surface;

a support for supporting the work surface on the first horizontal surface at an angle with respect to horizontal, the work surface having a first edge positioned proximal to an intended normal location of a user of a keyboard supported on the work surface system and a second edge positioned distal to an intended normal location of a user of a keyboard supported on the work surface system, the second edge comprising a cut out portion;

a computer keyboard support in the cut out portion, capable of assuming a non-coplanar orientation with respect to the work surface;

wherein the work surface is smaller than the first horizontal surface and has a size sufficient to provide support for arms of a user of a keyboard supported on the computer keyboard support.

* * * * *